US005154310A

United States Patent [19]

Massey

[11] Patent Number: 5,154,310

[45] Date of Patent: Oct. 13, 1992

[54] END NESTING STACKABLE CONTAINER MODIFIED TO MAINTAIN MATERIAL FIRMLY IN PLACE

[75] Inventor: Edward W. Massey, Parma, Ohio

[73] Assignee: Axia, Inc., Oak Brook, Ill.

[21] Appl. No.: 806,817

[22] Filed: Dec. 6, 1991

Related U.S. Application Data

[63] Continuation of Ser. No. 460,977, Feb. 12, 1990, and Ser. No. 309,783, Feb. 10, 1989, abandoned.

[51] Int. Cl.[5] ..... B65D 85/48

[52] U.S. Cl. ..... 220/448; 206/451

[58] Field of Search ..... 206/448, 451

[56] References Cited

U.S. PATENT DOCUMENTS

| | | | |
|---|---|---|---|
| 3,147,860 | 9/1964 | Kean, Sr. et al. | 206/448 |
| 3,371,798 | 3/1968 | D'Altrui | 211/193 |
| 3,762,343 | 10/1973 | Thacker | 108/53.5 |
| 3,809,234 | 5/1974 | Kurick | 206/448 |
| 3,938,660 | 2/1976 | Moehring | 206/448 |
| 3,946,876 | 3/1976 | Jay . | |
| 3,964,608 | 6/1976 | Rowley | 206/454 |
| 4,010,849 | 3/1977 | Pater | 206/454 |
| 4,186,667 | 2/1980 | Seabrook . | |
| 4,320,836 | 3/1982 | Brown | 206/454 |
| 4,489,835 | 12/1984 | Tombal | 206/454 |

FOREIGN PATENT DOCUMENTS

| | | | |
|---|---|---|---|
| 2854714 | 6/1980 | Fed. Rep. of Germany | 206/448 |
| 3619461 | 12/1987 | Fed. Rep. of Germany | 206/448 |
| 2447325 | 9/1990 | France | 206/448 |
| 1034953 | 8/1983 | U.S.S.R. | 206/448 |

*Primary Examiner*—Steven M. Pollard

*Attorney, Agent, or Firm*—Kirkland & Ellis

[57] ABSTRACT

An end nesting stackable container is modified with means to firmly contain material being shipped or stored inside the container. The means contact the load being shipped at at least 4 points and are advantageously pivoted out of the way of the container during nesting. The preferred embodiment is directed at the shipping and storing of automotive windshields.

22 Claims, 13 Drawing Sheets

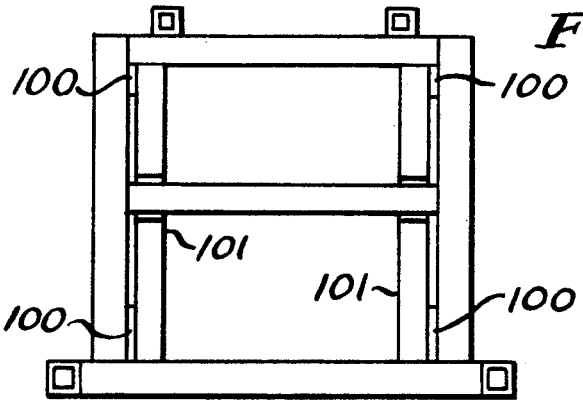
FIG. 11A
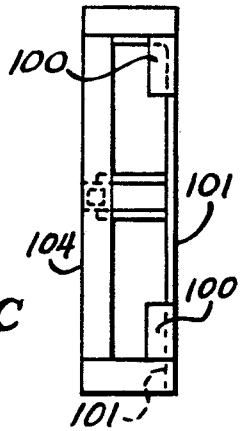
FIG. 11C
FIG. 11B
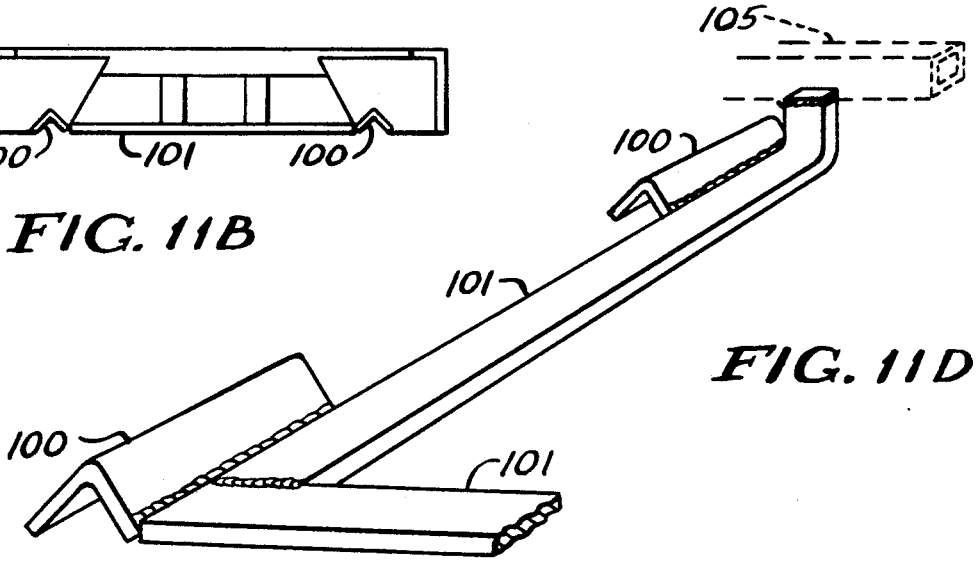
FIG. 11D
FIG. 11E
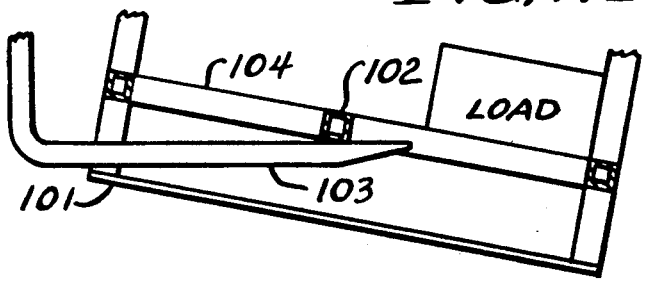
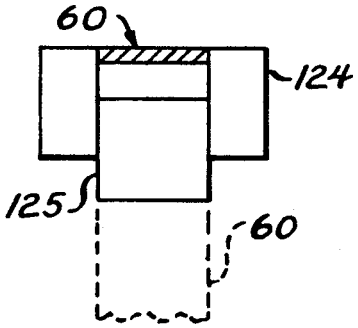
FIG. 12A
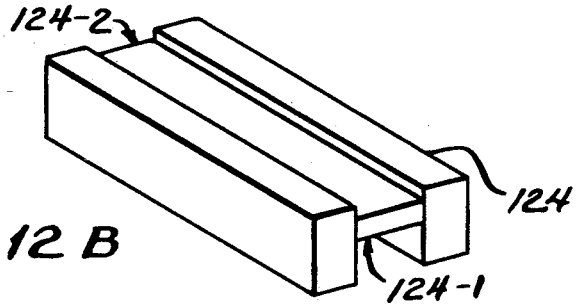
FIG. 12 B

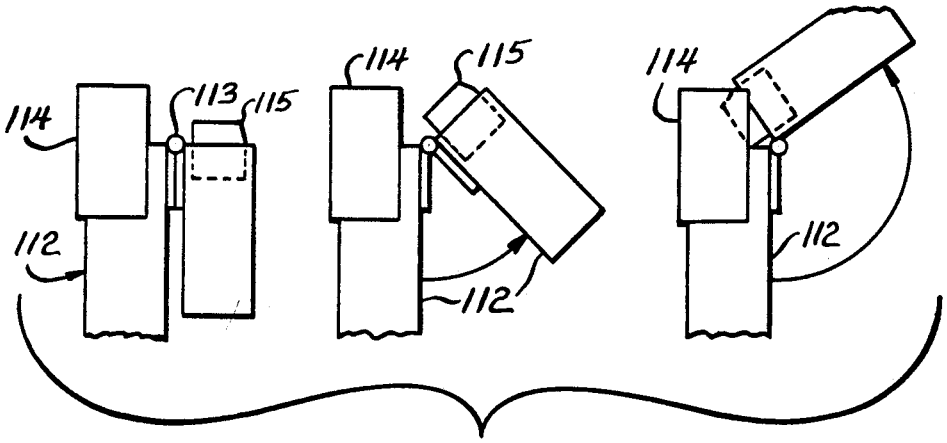
FIG.13A
FIG.13B
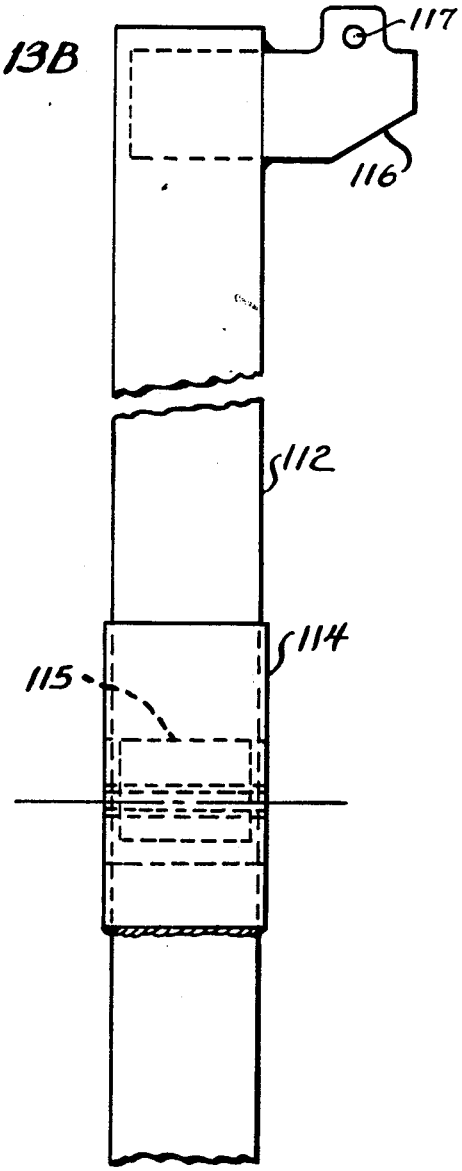
FIG.13C
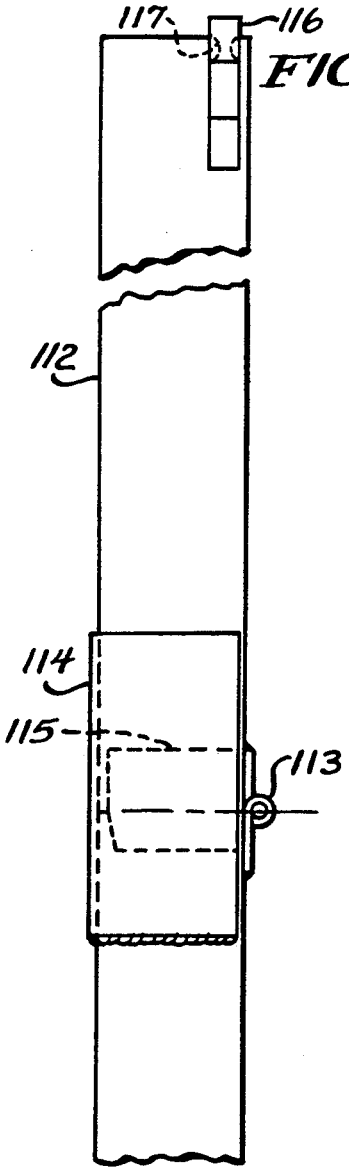

FIG. 14A
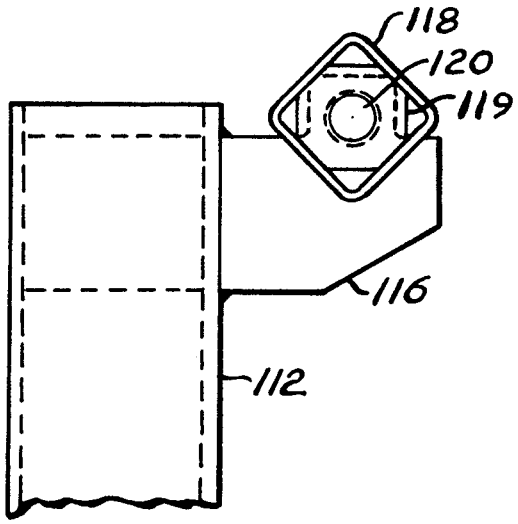
FIG. 14B
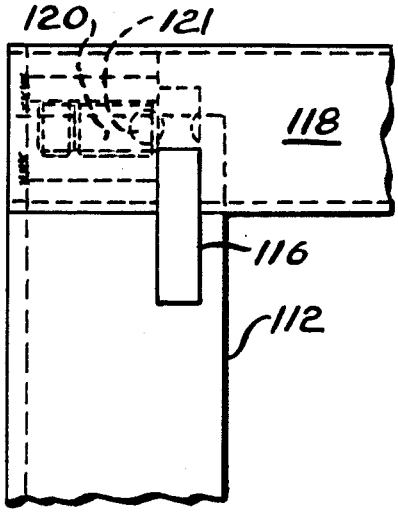
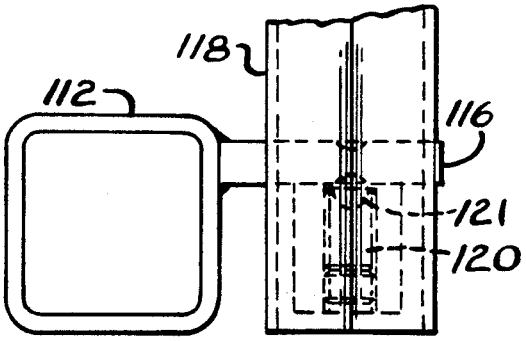
FIG. 14C
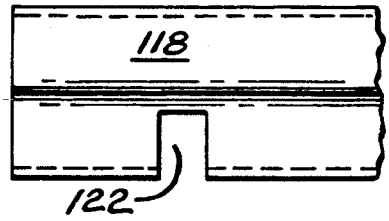
FIG. 14D
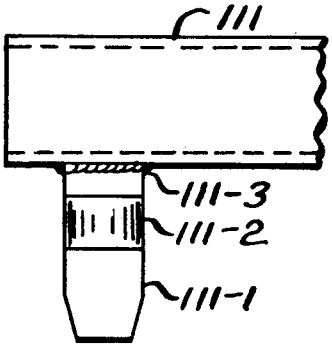
FIG. 15A
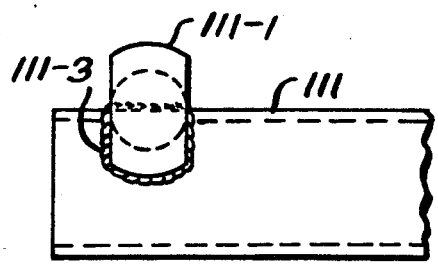
FIG. 15B FIG. 16A
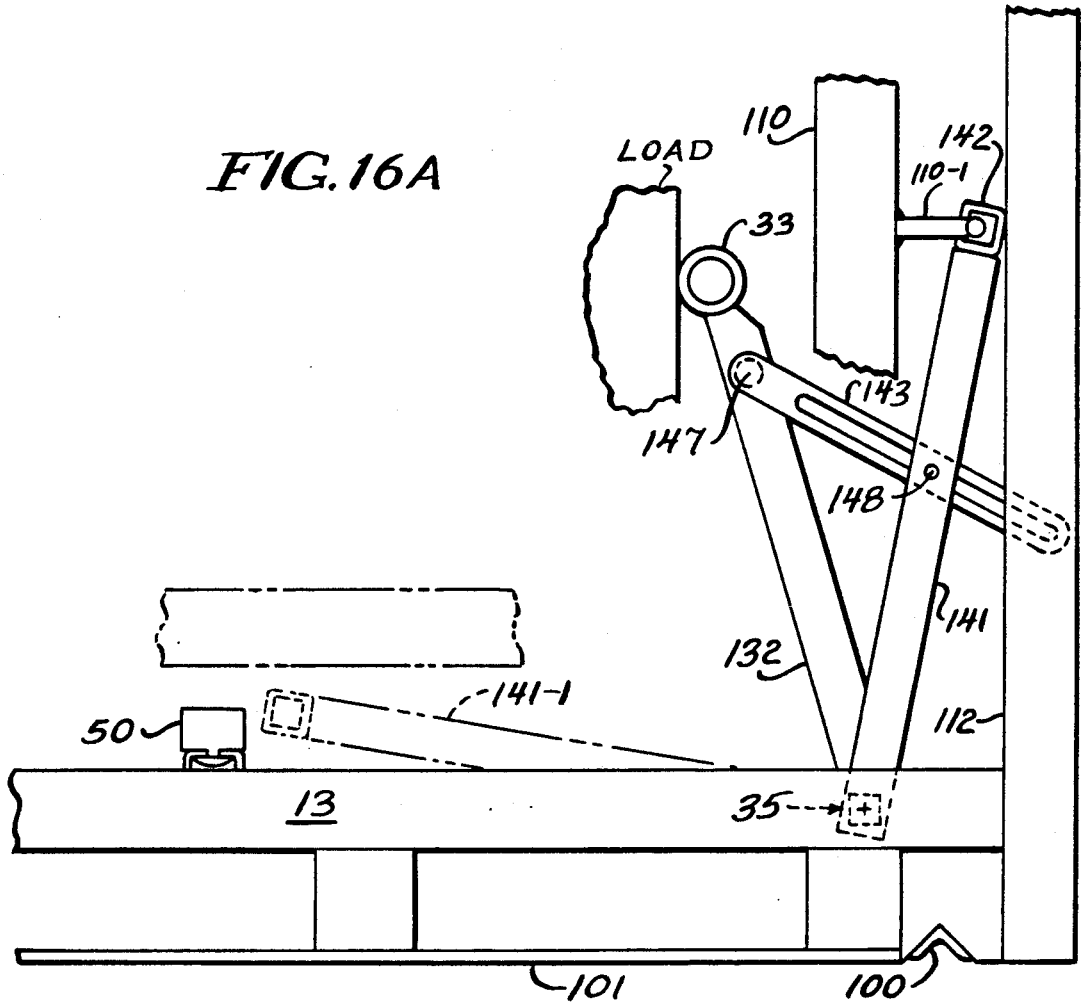
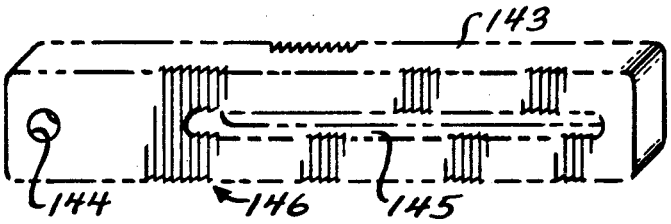
FIG. 16B
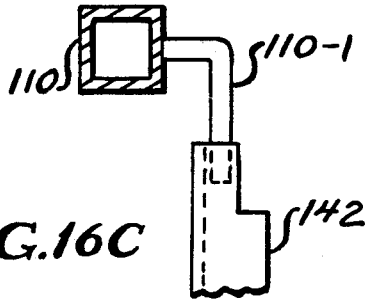
FIG. 16C

END NESTING STACKABLE CONTAINER MODIFIED TO MAINTAIN MATERIAL FIRMLY IN PLACE

This is a continuation of co-pending application Ser. No. 07/460,977 filed on Feb. 12, 1990 and Ser. No. 07/309,783 filed Feb. 10, 1989, now abandoned.

BACKGROUND OF THE INVENTION

1. Field of the Invention

This invention is in the field of shipping and storaging equipment. Specifically it relates to nestable and stackable storage and shipping equipment. More particularly it relates to improvements for securing material being handled in an end nesting stackable container.

2. Background Information

An end nesting stackable container is one which fits inside other like containers yet also stacks one on top of another. This combination of features allows for ease in shipping and storing material held in the containers by use of the stacking feature. Also the containers may be cost effectively shipped empty by use of the nesting feature because many empty nested containers take only the space of one filled container.

End nesting stackable containers are used throughout the world for shipping and storing and are disclosed in U.S. Pat. No. 3,762,343 to Thacker, which is herein incorporated by reference in its entirety. However, the currently employed containers have no means for securely holding material being shipped or stored. While the idea of securely holding loads inside a container used for shipping is not new, the currently employed methods are either temporary in nature or frustrate the nesting feature of the container which is the subject matter of this invention. It is therefore a principal object of the invention to provide a means for securing material being shipped wherein the means is attached to the container, yet is movable to allow the container to nest easily.

The preferred embodiment of the invention is directed at the shipping of glass plate or more specifically at glass automotive windshields. In this embodiment the load requires rigid containment within the end nesting stackable container to avoid damage during shipping Further, the glass plates or windshields must not be damaged by the means used for securing the load. Currently, glass windshields are commonly broken during shipping. While containment measures are employed, they do not allow the units to nest and they provide for little variation of glass panel size. Therefore, a need clearly exists for a safe, cost effective way to ship and store glass panels or windshields.

In addressing this need, it is another object of the invention to firmly contain glass plates or windshields within an end nesting stackable container It is a further object of the invention to provide a means for securing a load within an end nesting stackable container which does not damage the load.

SUMMARY OF THE INVENTION

An end nesting stackable container is improved by the addition of means to secure a load within the container. The means comprises at least a first means for securing the load from the top and a second means for securing the load from the sides. It is also possible to add a third means for protecting the load from the bottom. Particularly, the invention is directed to an end nesting stackable container which has been modified to allow for safe transportation and storage of fragile products, like glass plate or automotive windshields. The modifications include at least one top holddown arm, at least one side stabilizing mechanism on each side of the load and optionally a bottom load support. All the parts contacting the fragile load are optionally coated on at least one side with a material suitable to protect the load from damage. This material is preferably natural or synthetic rubber, high density foam or any other material with the proper abrasion and cushioning properties.

The top holddown mechanism has a holddown arm which is connected near one end to the holddown support. The holddown support is attached to the end nesting stackable container by stretching between the rear cross tube and the deck of the container. The side stabilizing mechanism works in cooperation with the side locking mechanism and includes a side stabilizer which is pivoted about a side attachment point by way of a side stabilizer support. The side locking mechanism comprises a lock bar collar which slides on a locking side support to lock the side stabilizer against the load in the container.

In operation, the top holddown arm swings down and is strapped to a bottom portion of the container to provide vertical stability during transportation. Also, the side stabilizer is pivoted to meet the load and locked into place by the sliding lock bar and lock bar collar, thus providing lateral stability. The locking into place of the side stabilizer is an important feature of the invention because it provides strong lateral stability. Another key aspect of the invention is that when the modified container is empty, the securing means pivot out of the container to allow the container to properly nest with other like containers.

BRIEF DESCRIPTION OF THE DRAWINGS

The objects and advantages of the present invention will be better understood from a reading of the following detailed description in conjunction with the accompanying drawings in which:

FIGS. 11A–11E are views of a bottom assembly illustrating a stirrup safety feature in a second preferred embodiment of the container;

FIGS. 12A and 12B show portions of the top holddown mechanism in a second preferred embodiment;

FIGS. 13A, 13B and 13C are sequential, front and side views, respectively, of a hinged front column in the second preferred embodiment;

FIGS. 14A, 14B, 14C and 14D are front, side and top views of the front column-side member engagement and a side view of the side member in the second preferred embodiment;

FIGS. 15A–15K show the swivel locking mechanism engagement of the side member and rear cross tube in the second preferred embodiment; and FIGS. 16A, 16B and 16C show portions of a second preferred embodiment of the side stabilizing and locking mechanisms.

DETAILED DESCRIPTION

While it was noted earlier it should be again stated that this invention incorporates the invention in U.S. Pat. No. 3,762,343 to Thacker, which is fully incorporated by reference.

Figure 1:
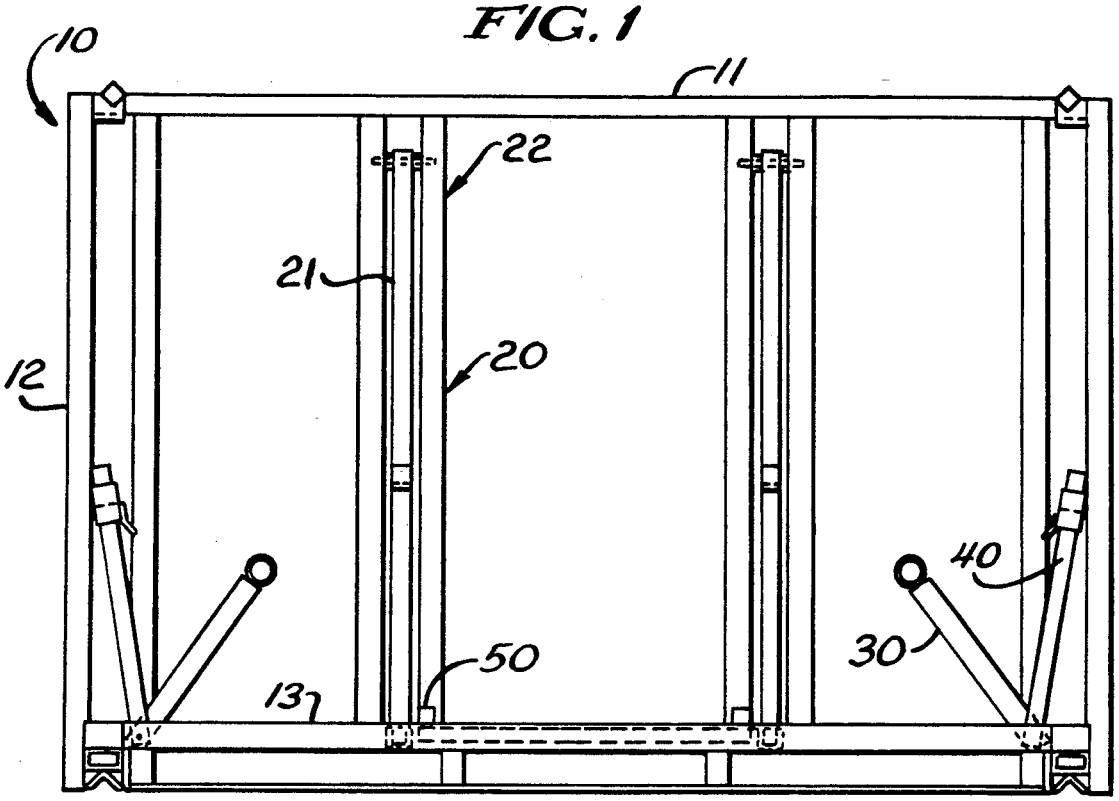
FIG. 1 shows the modified end nesting stackable container from the front with the side stabilizers drawn as if contacting a load.

Referring to the drawings, FIG. 1 shows the end nesting stackable container 10 with the top holddown mechanism 20, the side stabilizing mechanism 30, the side locking mechanism 40 and the optional bottom load support 50. The top holddown mechanism 20 is principally comprised of a holddown arm 21 and a holddown support 22. The holddown support is connected to the end nesting stackable container by stretching between a rear cross tube 11 of the container and the deck of the container 13. It should be noted that the holddown support 22 provides additional rigidity to the container. While FIG. 1 shows the holddown support connected to the upper rear cross tube 11 of the end nesting stackable container 10 and to the deck of the container 13, one skilled in the art would know that the connection points of the holddown supports can be to other rear cross tubes should they exist in the container.

The end nesting stackable container as modified is advantageously fabricated by welding metal tubes together to provide the strength and rigidity needed for safe shipping and storing. However, other materials with similar properties can be used such as composite plastics, wood, fiber-reinforced paper and RIM plastics. Similarly, other fabrication techniques beyond welding can be used, provided that the properties necessary for a strong shipping container are not compromised.

Figure 3A:
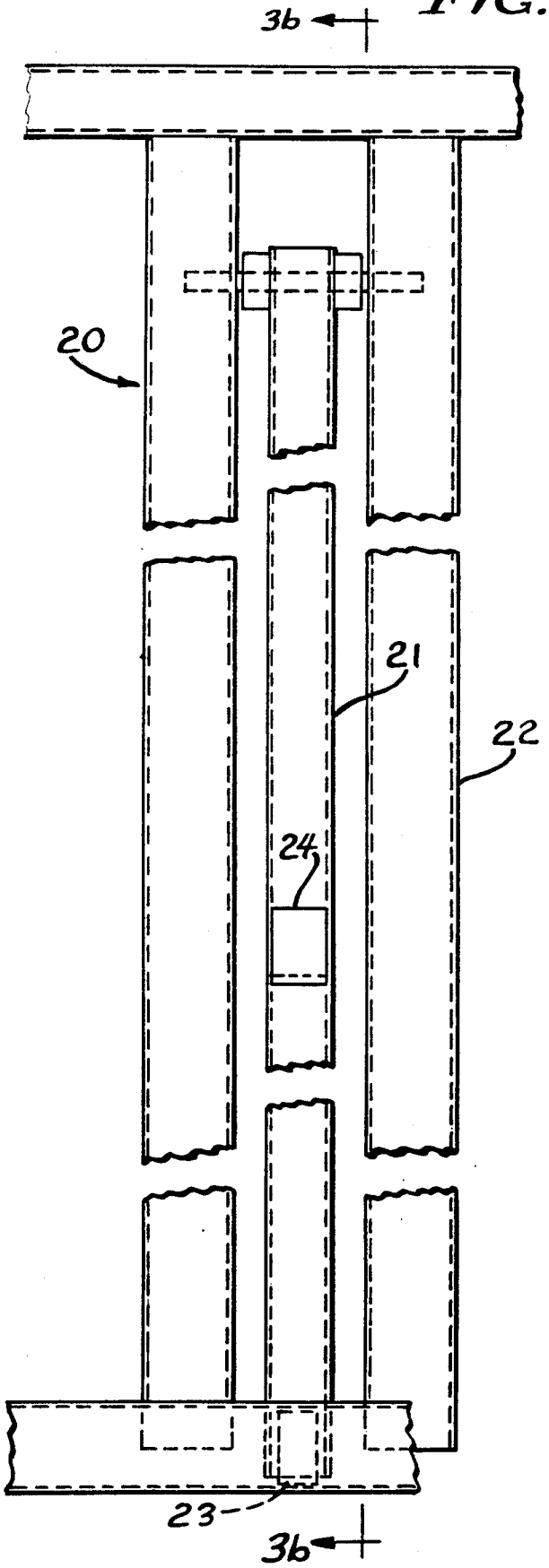
FIGS. 3*a* and 3*b* are details of how the holddown arm sits at rest and connects to the holddown support.

Looking now at the details of how the top holddown mechanism 20 is constructed, it is shown in FIG. 3*a* that the holddown arm 21 fits to at least one, preferably between two holddown supports 22. It will be appreciated by one of ordinary skill that a suitable embodiment with a single holddown support can be designed while FIG. 3*a* shows only the embodiment with two holddown supports.

The holddown arm is attached to the holddown support at a holddown attachment point. The holddown attachment point allows the holddown arm to pivot with respect to both the holddown support and the container. In this particular embodiment, the holddown attachment point is a holddown support slot 27 shown in FIG. 3*b*. As FIG. 4 shows more clearly, the holddown support 22 has a holddown support slot 27 which allows the holddown arm to slide within the holddown support, thereby allowing the holddown arm to be secured at different levels on the holddown support. This gives the top holddown mechanism the ability to accommodate a wide range of windshield panel sizes. Of course other embodiments of the idea of being able to secure different size loads are contemplated by this invention. Another embodiment, for example, in place of a holddown support slot, would be holddown support points or holes at predetermined levels in the holddown support.

Figure 3B:
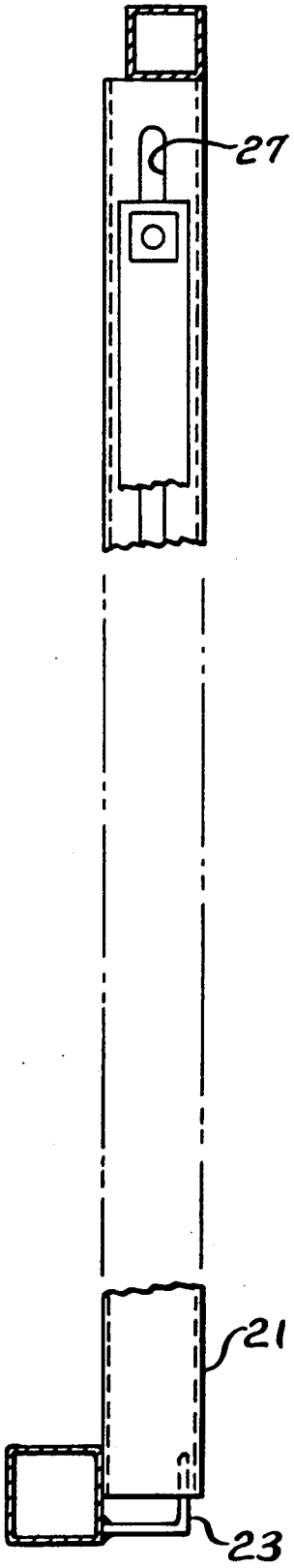
Figure 4:
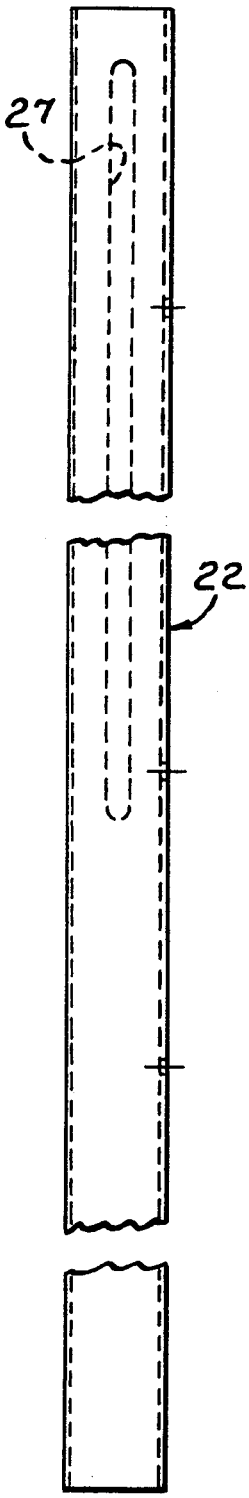
FIGS. 4 and 5*a* and 5*b* are details of the holddown support and the holddown arm, respectively.

FIG. 3*b* is a side view of FIG. 3*a* and further shows the top holddown mechanism at rest, namely in position to allow the end nesting stackable container to nest. Here, the holddown arm 21 is able to slide onto a holddown first clip 23 which functions to secure the holddown arm firmly in place during nesting. The holddown arm 21 is able to slide onto the holddown first clip 23 by sliding in the holddown support slot 27.

Figure 5A:
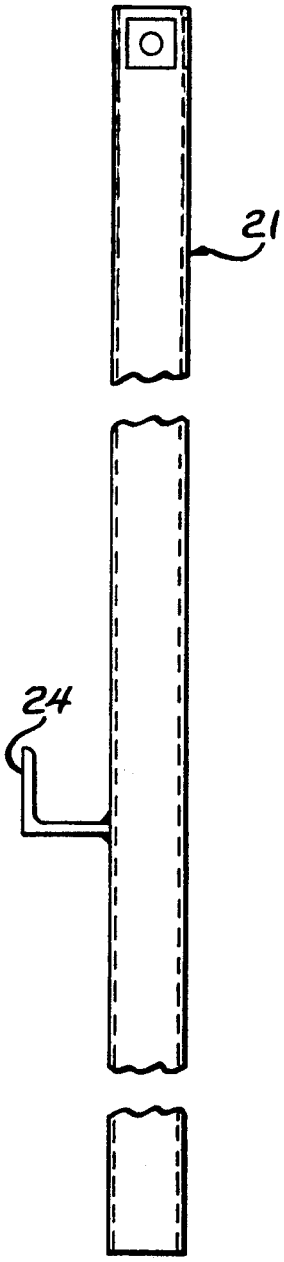
Figure 5B:
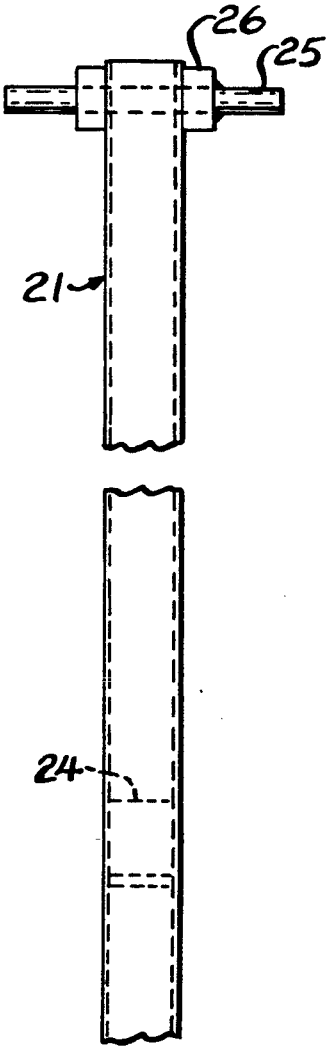

Referring now to FIGS. 5*a* and 5*b*, there is shown the details of the holddown arm 21. FIG. 5*a* shows the holddown second clip 24 which functions to secure the holddown arm out of the way of the end nesting stackable container during loading. This operation is displayed more specifically in FIG. 8*a*. Looking at FIG. 5*b*, the pinning means by which the holddown arm 21 is attached to the holddown support is shown. A holddown support pin 25 is provided which fits inside the holddown support slot 27. Also provided is a holddown support pin spacer 26 to give consistent separation between the holddown arm and the holddown support for ease in sliding and pivoting with respect to one another.

Note that the holddown arm is optionally coated or covered on at least one side, namely the side contacting the load, with a material suitable for protecting the load from damage such as natural or synthetic rubber, high density foam or any other material with the proper abrasion and cushioning properties. It will be understood that the material must only be able to withstand abrasion and provide the necessary cushion effect.

Figure 10:
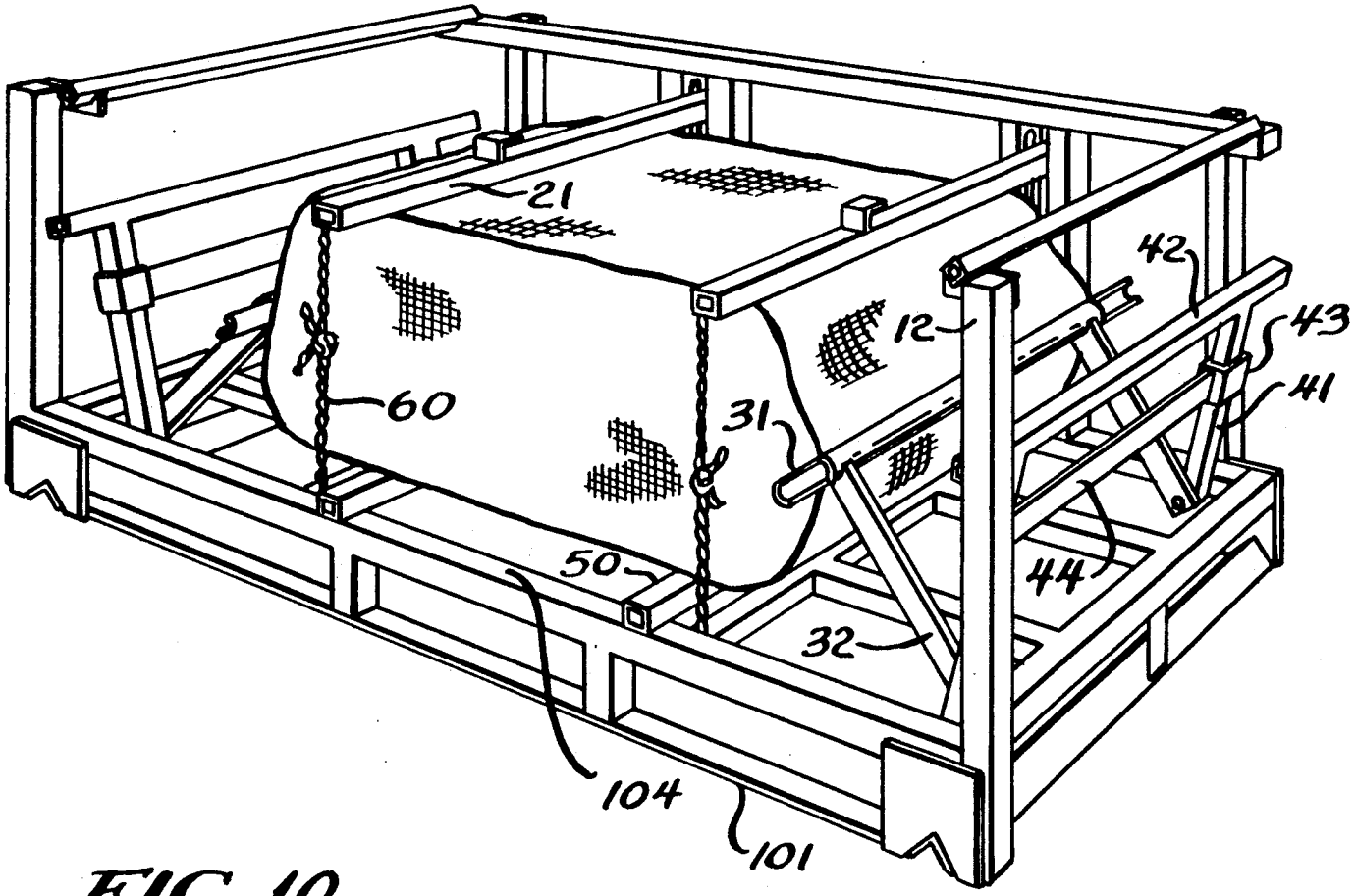
FIG. 10 shows the modified end nesting stackable container fully loaded in its preferred embodiment.

Looking briefly at FIG. 10, there is shown the tie down means 60 for securing the holddown arm against the load. This tie down strap is connected from the end of the holddown arm to the deck of the container and prevents the load from shifting during shipping.

Figure 2:
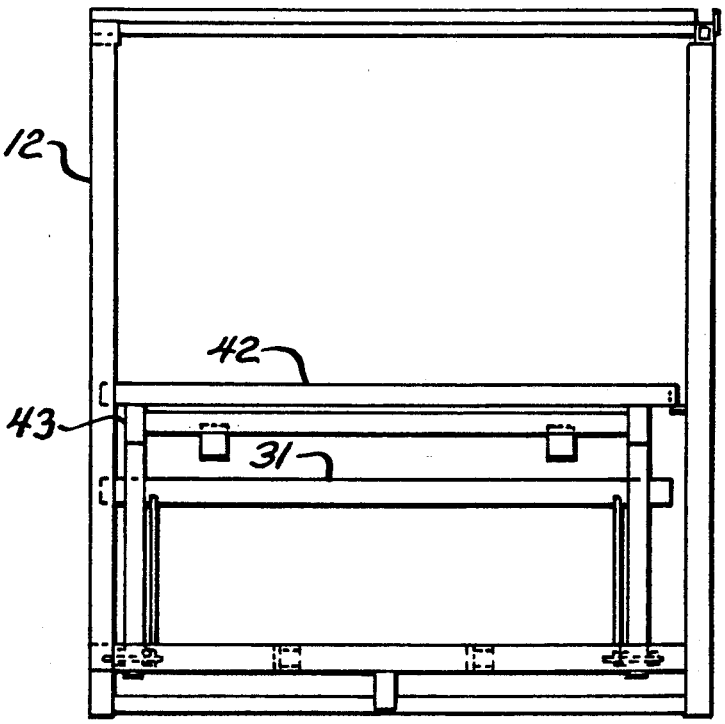
FIG. 2 is the modified end nesting stackable container from the side.

Shifting now to the second major means for securing a load within an end nesting stackable container, FIG. 1 shows the side stabilizing mechanism 30 which works in conjunction with the side locking mechanism 40. FIG. 2 shows a side view of this system.

Figure 6A:
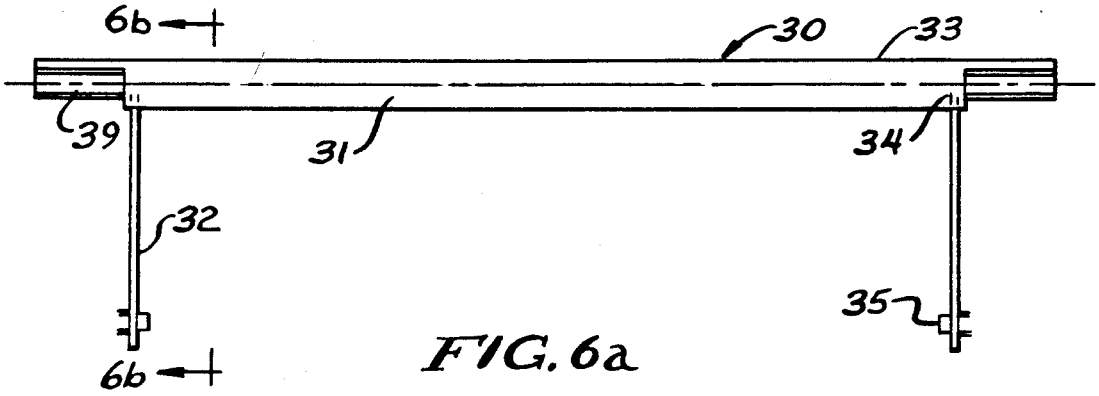
FIGS. 6*a*–6*c* are details of the side stabilizing mechanism.
Figure 6B:
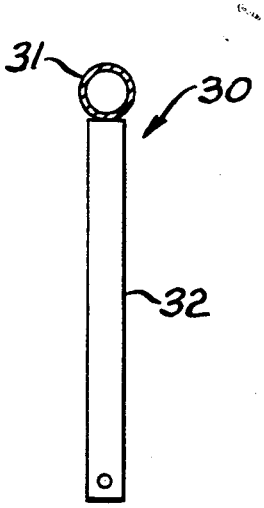
Figure 6C:
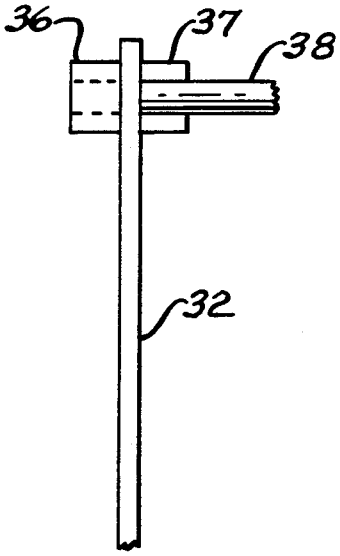

Turning to FIGS. 6*a*, 6*b* and 6*c*, these show the details of the side stabilizing mechanism 30. The side stabilizing mechanism comprises a side stabilizer 31 and a side stabilizer support 32. The side stabilizer 31 contacts the load in the container on the first face of the side stabilizer 33 as shown in FIG. 6*a*. The first face of the side stabilizer is optionally coated or covered with a suitable material to protect the load from damage, preferably natural or synthetic rubber, high density foam or any other material with the proper abrasion and cushioning properties. It should be noted that at least one side of the side stabilizer is beneficially covered; however, the entire side stabilizer could be coated. The side stabilizer is connected to the side stabilizer support 32 at or near one end of the side stabilizer support as detailed in FIG. 6*b*.

The side stabilizer support 32 is connected at the end opposite of the side stabilizer to the side attachment point 35. The side attachment point is detailed in FIG. 6*c* and is the site of the side pivot pin 38 which is the pin that the side stabilizer support 32 pivots about. Also at the side attachment point is the first side spacer 37 which provides consistent separation between the side stabilizer support and the locking side support 41; FIG. 7*c* will help clarify this point. Also in FIG. 6*c* there is shown the side pin cap 36 which serves to retain the side stabilizing mechanism and the side locking mechanism on the side pivot pin 38.

Returning again to FIG. 6*a*, there is shown a cut away portion 39 of the side stabilizer 31. The cut away portion allows the side stabilizer to clip to the locking mechanism because contact between the side stabilizer and the locking side support 41 is avoided until the center portion of the side stabilizer reaches the locking side support. This is more fully discussed below.

As noted earlier, the side stabilizing mechanism preferably works in conjunction with the side locking mechanism. For example, FIG. 2 shows how the side locking mechanism connects to the container with the side stabilizing mechanism. However, to fully understand this, it is first necessary to explain the details of the side locking mechanism.

Figure 7A:
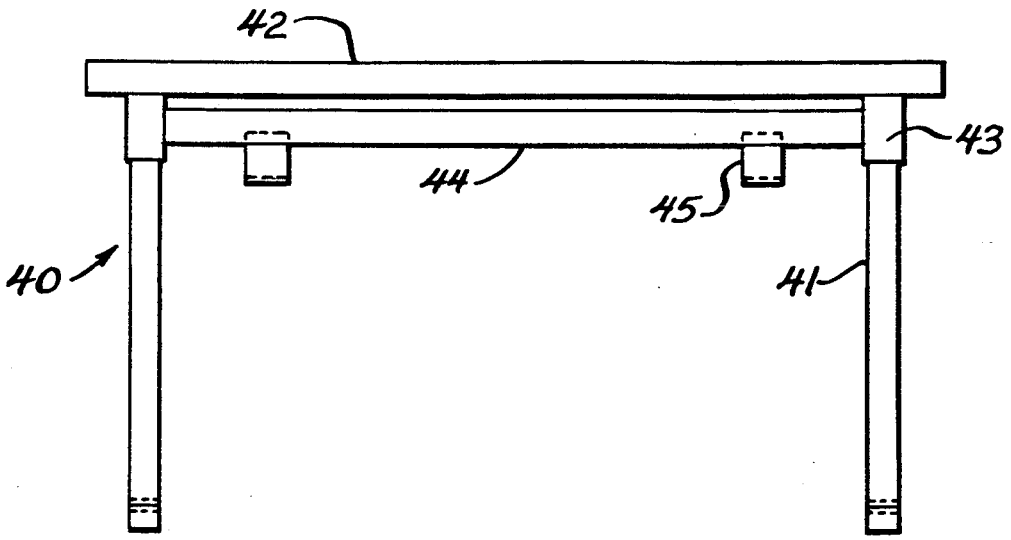
FIGS. 7*a*–7*c* are details of the side locking mechanism.

Referring first to FIG. 7*a*, there is shown the entire side locking mechanism 40. The mechanism comprises at least one locking side support 41, at least one locking top support 42, at least one lock bar collar 43 and optionally a lock bar 44. The central component is the locking side support 41 which connects at or near one end to the locking top support 42. The locking side support is connected at or near its opposite end to the container at the side pivot pin 38 as shown in FIG. 7*c*. The side pivot pin is the pin about which the entire side locking mechanism pivots with respect to both the container and the side stabilizing mechanism.

Figure 7B:
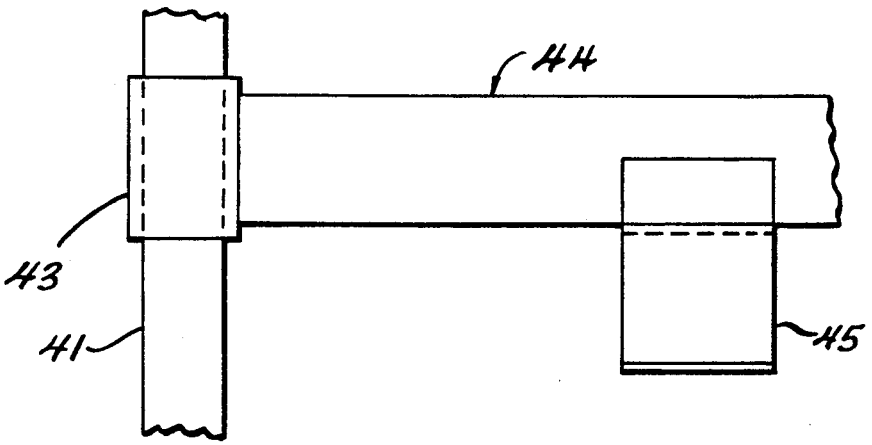
Figure 7C:
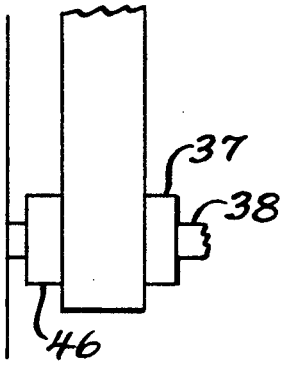

The side locking mechanism also comprises a lock bar collar 43 which slides along the length of the locking side support 41 as shown in FIG. 7*b*. Along with the lock bar collar is the lock bar 44, each side of which is connected to each lock bar collar and which slides with the collar. Finally, along the length of the lock bar is the locking clip 45. The locking clip functions to lock the side stabilizing mechanism to the locking mechanism when the lock bar and lock bar collar are in the up position; this is shown in FIG. 8*b*.

Now, with all the components of the side stabilizing mechanism and the side locking mechanism described, it is important to understand how the two mechanisms work together.

Looking first to FIG. 2, there is shown an end view of the end nesting stackable container. This shows the side stabilizer 31 in relation to the locking top support 42 and the lock bar collar 43.

Figure 8A:
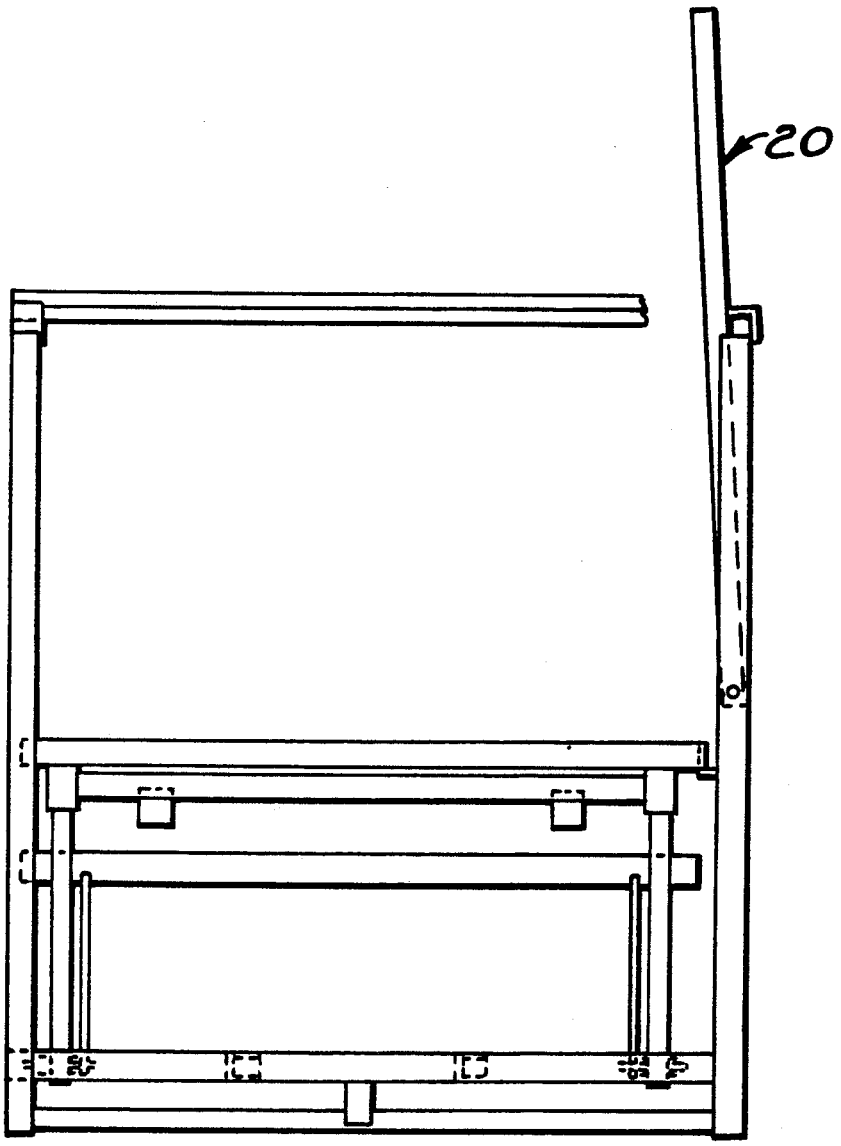
FIGS. 8*a* and 8*b* show the modified end nesting stackable container as prepared to be loaded.
Figure 8B:
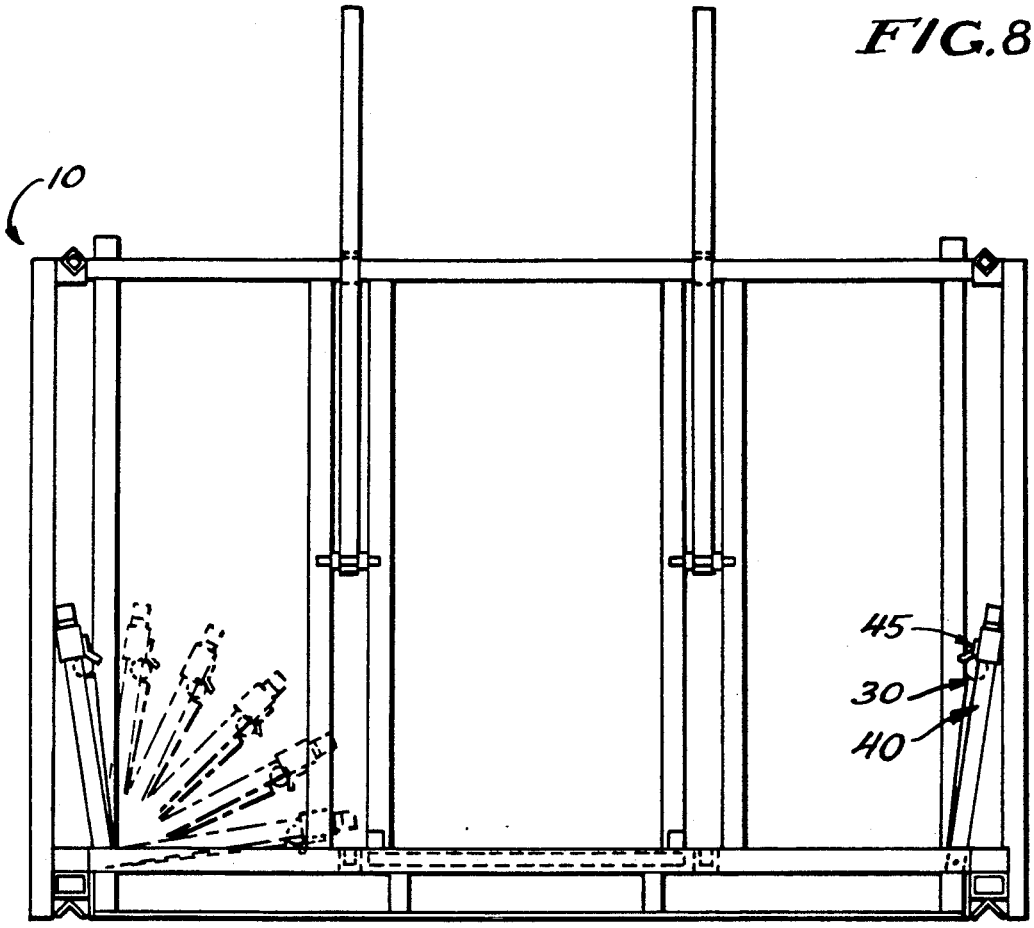

As shown further in FIG. 8*b*, when the end nesting stackable container 10 is being loaded the side stabilizing mechanism 30 is locked to the side locking mechanism 40 by the locking clip 45. This condition allows the side stabilizing mechanism and the side locking mechanism to pivot together with respect to the container as shown on the left side of FIG. 8*b*. Thus, the two mechanisms can pivot up to allow for loading the container and they can pivot down so the container can nest.

In the loading position, a safety mechanism is contemplated to assure that the side stabilizing mechanism 30 and the side locking mechanism 40 stay in the "up" position. If the mechanisms should swing down during loading, glass could be damaged.

The second way that the side stabilizing mechanism and the side locking mechanism work together is shown most clearly in FIG. 10, that is, after the end nesting stackable container has been loaded. After loading, the side stabilizer 31 is unlocked from the locking clip and is pivoted to contact the load. Specifically, in FIG. 10 the side stabilizer is contacting a load of glass windshields. The lock bar collar 43 and the lock bar 44 are then translated along the locking side support 41 and the collar is wedge fitted into the angle formed between the side stabilizer support 32 and the looking side support 41.

The wedge fit is important because the load must be firmly held in place to avoid damage. The wedge fit places constant pressure on both the load and the container front column 12. To describe this more systematically, the locking top support 42 abuts the container front column 12, thereby giving leverage to the lock bar 44 and the lock bar collar 43 to force the side stabilizer support 32, and thus the side stabilizer 31, against the load, thereby preventing the load from moving laterally during shipping. This is shown clearly in FIG. 2 where the locking top support 42 is designed to contact the container front column 12. This new and unique feature in shipping equipment provides the rigidity and strength to hold a load in place during shipping.

Figure 9:
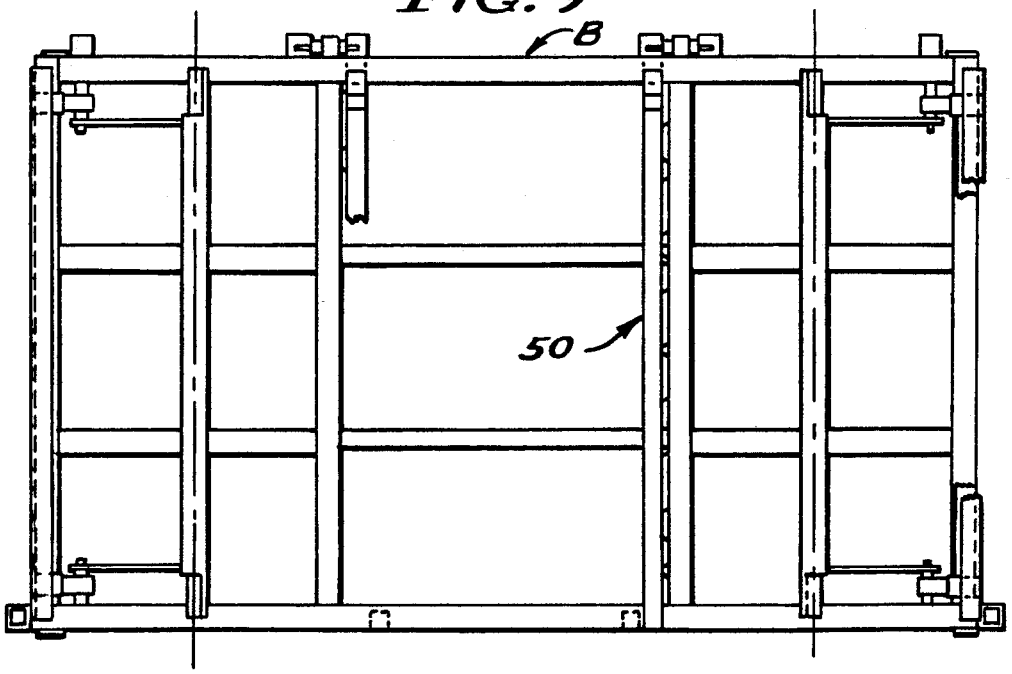
FIG. 9 is a top view of the modified end nesting stackable container.

Returning once more to FIG. 1, there is shown a bottom load support 50. The bottom load support stretches between the front and rear of the end nesting stackable container deck 13, as is more clearly shown in FIG. 9. Typically the bottom load support is welded to the deck of the container, but a removable support is also possible. The bottom load support is used with the preferred embodiment, that is in shipping glass windshields. It is preferably coated or covered on at least one side with a suitable material to prevent damage to the load. In the most preferred embodiment it is coated on at least one side with natural or synthetic rubber, high density foam or any other material with the proper abrasion and cushioning properties. It should be noted that when shipping glass windshields, the coating material on the bottom load support is formed with individual slots to provide a constant spacing between the windshields to prevent the windshields from contacting each other during shipping.

Also contemplated within this invention is a method for shipping and storing automotive windshields which comprises providing an end nesting stackable container which is modified to contact the load of windshields on at least four sides. Basically, this contemplates contact from the top holddown arm 21, from the bottom load support 50, and from each side from the side stabilizer 31 as shown on FIG. 10. This method of shipping and storing provides the lateral and vertical stability necessary to prevent breakage in shipment.

To load the end nesting stackable container as modified as described above, the unit to be loaded must be free from the nested stack of other like units. Both sides of the side stabilizing mechanism 30 must be in the upright position, namely locked to the side locking mechanism 40 as shown in FIG. 8*b*. The two mechanisms can then be secured to the container in the upright position. The top holddown mechanism 20 is placed in the upright position by clipping it to the rear cross support of the container as shown in FIG. 8*a*. The container is then loaded with glass windshields by placing each windshield on the bottom load support face coated with a material suitable to protect the glass windshields from damage.

After fully loading the container, the side stabilizing mechanism is unlocked and pivoted to meet the side of the windshield. The lock bar and lock bar collar drop into the wedge fit angle. The top holddown arm is then unclipped from the container and placed over the glass. A tie strap is connected from the front of the top holddown arm to the deck on the container which holds the windshields during transportation. The fully loaded container is shown in FIG. 10.

A second preferred embodiment of the invention will now be described that incorporates several modifications and additional features to the end nesting stackable container 10. Where appropriate, elements of the second preferred embodiment are identified in the below-described Figures by reference numerals increased in value by one hundred over reference numerals identifying corresponding elements of the first preferred embodiment.

As noted at column 3, lines 33–43, for example, of U.S. Pat. No. 3,762,343 to Thacker (hereinafter the "Thacker patent") that has been incorporated by reference, many of the structural members of the container are advantageously hollow, tubular members of generally square cross-section and 1.5–2 inches on each side. Dynamic testing of container components in accordance with the present invention indicates that, for some vibrational environments, suitable component sizes may be somewhat larger in size and thickness to overcome the influence of harmonic vibrations. Such heavier components also contribute to making the container more rugged and give the container improved endurance as demonstrated by impact testing.

A modification to the bottom assembly or deck structure of the container described in the Thacker patent which permits product placement within reduced overall height and lowers the deck height by approximately one inch and provides a "stirrup" safety feature is illustrated in FIGS 11A–11E. As seen most clearly in the side view of FIG. 11C and the partial front-to-rear perspective view of FIG. 11D, substantially 9-inch-long inverted V-shape members 100 are disposed at the front and rear of the bottom of the container (also seen in the top and front views of FIGS. 11A and 11B, respectively) rather than the continuous inverted V-shape members that extend from the front to the back of the container as described in the Thacker patent. The members 100 at the front of the container are joined by a length of flat stock 101 which is attached to their inner faces, for example by welding. An additional member 101 joins the front V-shape member 100 to the rear member 100, as seen most clearly in FIG. 11D. The front-to-back member 101 (one of which is shown in FIG. 11D) also has its rearward end bent upwardly so that it can be suitably attached, as by welding, to the bottom rear member 105. It will be understood that the configurations on both sides of the container are substantially similar. The width of each member 101 may advantageously be about three inches.

The advantages and features provided by the V-shape members 100 are those of the continuous members. In addition, members 100 and 101 provide a "stirrup" safety feature that is useful when front or side entry of the container by a lifting machine such as a forklift is utilized. For example, if in loading material into the container, the load is placed in the rear only, this could create an unbalanced condition when the forks of a lifting device are engaged into lift position. As seen from FIG. 11E, without the members 100, 101, the container could pivot on the front ends of the forks and transverse base member 102 and roll-off (one fork 103 is partially shown in FIG. 11E); but with the forks engaged between the top surface of a stirrup formed by the member 101 and the bottom side of the deck 104 of the container, the container cannot roll-off.

A modification of the above-described top holddown mechanism 20 provides greater strength and rigidity, reduced space requirements for the container and approximately two more inches of usable product space. As illustrated in FIGS. 12A and 12B, the modified top holddown mechanism includes a modified holddown arm 124 that is formed of a channel modified as shown. The modified holddown arm 124 provides a first channel section 124-1 for insertion of a removable cushion 125 of rubber or other elastomeric material, shown in the front view of FIG. 12A, for cushioning the load as described above. In addition, the holddown arm 124 provides a second channel section 124-2 for retaining the top holddown strap 60. The operation of the modified top holddown mechanism 120 is otherwise substantially identical to that of holddown mechanism 20 described above.

A further modification permits loading of the container free of potential interference from the front columns and the front-to-back, top side frame members. As described in more detail below, the container front columns are hinged, and a swivel locking mechanism joins the top side frame members to the rear top frame member. The swivel locking mechanism assures positive, secure placement and stacking of loaded containers.

Referring to FIGS. 13A–C, there are shown sequential, front and side views of portions of a hinged front column 112 which can be pivoted on a hinge 113 from a lowered position (shown on the left in FIG. 13A) used for loading the container through intermediate positions (shown in the center and right of FIG. 13A) toward an upright position (seen in FIGS. 13B and 13C) used for stacking and shipping. Hinge 113 is conveniently attached to the column 112 by welding at a position located a suitable distance, such as forty inches, above the container deck. A reinforcing member 114 is welded to one of the portions of column 112 to provide protection for the joint at hinge 113. For positive locating of the upper and lower portions of column 112, a tapered insert 115 (seen most clearly in FIG. 13C) may be attached within one or the other of the column portions so that the insert 115 bridges the joint at hinge 113. It will be appreciated that the length, tapering and other aspects of the shape of insert 115 are such that insert 115 does not interfere substantially with the pivoting of the column portions.

Several advantages are provided by hinging the front columns as just described. For most typical applications, it is necessary to have two men load items such as glass sheets into the container. Each man holds one end of the glass at its top edge, and walks on the outside of the container to the rear of the unit to deposit the glass. Without the hinge assembly as shown in FIGS. 13A–13C, each man would have to reach over the columns and sides of the container, which are usually approximately fifty-four inches up from the floor. With the front columns hingeddown as described, each man has to lift over columns that are only about forty inches high.

Also seen in FIGS. 13B and 13C is a short metallic support 116 that is welded to the upper portion of the front column and that extends inwardly therefrom to underlie the front of the top side frame member as described further below. As seen in FIG. 13C, the support 116 includes a curved depression 117 for accepting a ball plunger disposed in the top side frame member.

Referring now to FIGS. 14A–14D, there is shown the engagement of the front column 112 and the front of top side frame member 118. The front elevation in FIG. 14A shows an insert 119 in the hollow tubular member 118 for a conventional ball plunger 120 which is screw-threaded into insert 119 to a depth sufficient for ball 121 to contact the curved depression 117 (seen most clearly in the side and top views, FIGS. 14B and 14C, respectively). A suitable notch 122 in member 118 accepts the metallic support 116, as seen in FIG. 14D.

Figure 15C:
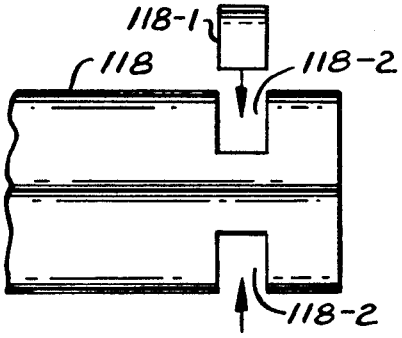

The swivel locking mechanism joining the top side frame member 118 to the rear top frame member, or cross tube, 111 is illustrated in FIGS. 15A–15K. Referring to FIGS. 15A and 15B which are partial plan and front views, respectively, a pin 111-1 in the shape of a truncated cylinder and having an area 111-2 of circular cross-section is secured to the rear cross tube 111 by a convenient means such as welding at point 111-3. The pin 111-1 may extend into the top side frame member.

Figure 15D:
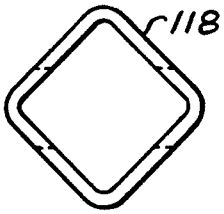
Figure 15E:
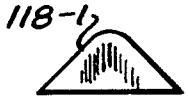
Figure 15F:
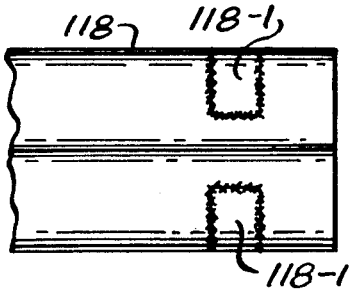
Figure 15G:
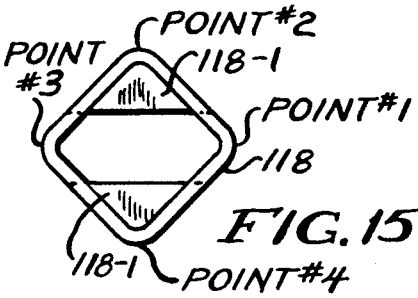
Figure 15H:
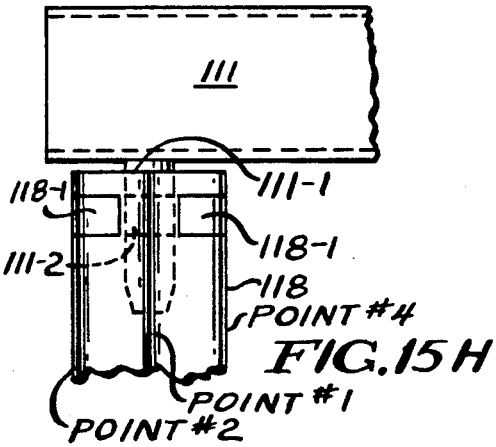

The pin 111-1 is inserted into top side frame member 118, the rear end of which is shown from the side in FIG. 15C and from the rear in FIG. 15D. As seen most clearly in FIG. 15C, side member 118 includes at least one notch 118-2 (two are shown in FIG. 15C) into each of which is inserted a V-insert 118-1 as indicated by the heavy arrow in FIG. 15C. The V-insert 118-1 is shown from the side in FIG. 15E, and is suitably fixed in notch 118-2, for example, by means of welding. FIGS. 15F and 15G show side and rear views, respectively, of the side member 118 with two V-inserts 118-1 installed. It will be noted from the Figures that the V-inserts substantially maintain the shape of member 118 to avoid interfering with the stackability of the container. Four vertices of the generally square-cross-section of member 118 are identified in FIG. 15G to aid understanding of the further description of the swivel locking mechanism.

Figure 15J:
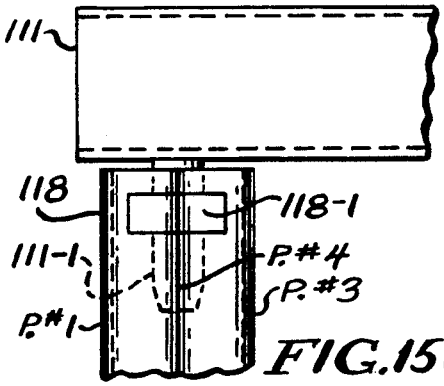
Figure 15I:
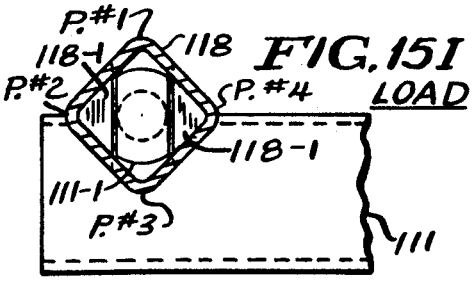
Figure 15K:
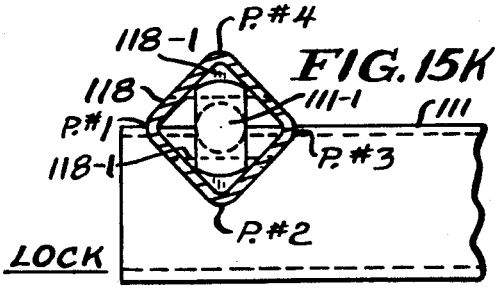

Referring now to FIGS. 15H–15K, there are shown views of the swivel locking mechanism in the open, or load, position (FIGS. 15H–15I) and the lock position (FIGS. 15J–15K). As shown from the top in FIG. 15H and the front in FIG. 15I, in the load position, pin 111-1 is inserted into side member 118 such that circular area 111-2 is proximate the V-inserts 118-1. Once in that position, the side member 118 is rotated ninety degrees into the lock position shown from the top in FIG. 15J and the front in FIG. 15K. In this way, the V-inserts move around the circumference of the circular area 111-2 into the slots, or grooves, formed between the larger-diameter portions of the pin 111-1, and the side member 118 can no longer be withdrawn from the pin 111-1.

It will be understood that the direction of rotation of top side frame member 118 is determined by its orientation with respect to the short metallic support 116 on the front column 112. A counterclockwise rotation is seen in the Figures from the orientations of Points 1–4. Furthermore, normal manufacturing tolerances of the swivel locking mechanism components permit the top side frame member 118 to be locked or unlocked to the rear top frame member 111 while the member 118 and column 112 are disengaged.

The swivel locking mechanism described above advantageously provides positive, secure placement of loaded containers at the same time as it facilitates easy loading and disassembly of empty containers.

It has been found that a second preferred embodiment of the side stabilizing and locking mechanisms provides more stable and secure side-retaining force to the product in the container while retaining the advantages of the abovedescribed mechanisms. As described in more detail below, the modified side stabilizing and locking mechanisms include an interlocking sawtooth linkage which, when positioned as desired, is firmly locked in place by engagement of two lock knobs.

Referring to FIG. 16A, a magnified front view of a portion of the container shows the front column 112, rear corner post 110, container deck 13, bottom load support 50 and inverted V-shape member 100 and member 101. Also shown is modified locking side support 141 that is pivotally connected, as described above, at side attachment point 35 to deck 13 and modified side stabilizer support 132. Support 132 supports side stabilizer 33 as described above, and is selectively positioned with respect to support 141 by a lock lever bar 143, shown in more detail in FIG. 16B. The lock lever bar 143 includes a pivot point 144, adjustment slot 145 and sawteeth 146 along one surface of the bar 143. As seen in FIG. 16A, lock bar 143 is joined to side stabilizer support 132 at pivot point 147 by any suitable device such as a screw or other fastener that can control the pivoting of the bar 143 with respect to support 132. Bar 143 is similarly located and releasably locked by suitable means such as a lock knob in position with respect to the side support 141 at lock point 148. It will be understood that the bar 143 is oriented between support 132 and support 141 so that sawteeth 146 engage a surface of support 141.

Also seen in FIG. 16A is a short metallic angle member 110-1 that can be welded to rear corner post 110 for restraining and supporting the rear of a modified locking top support 142 while the front of support 142 is restrained by the front column 112. The configuration of post 110, member 110-1 and support 142 is shown from the top in FIG. 16C. The out-out portion of the end of support 142 permits the support 142 to be rotated down to the nesting position as shown by the phantom side support 141-1 in FIG. 16A.

The side stabilizer support 132 is moved into contact with the container load by hand, and then is locked in position at lock point 148.

It will be understood that the modified side stabilizing and locking mechanisms are easily rotated toward the container deck for nesting as shown by the phantom side support 141-1 in FIG. 16A.

Specific embodiments of the present invention have been described above in detail; however, it will be understood that this description is to be considered in all senses illustrative rather than restrictive. Those skilled in the art will recognize other embodiments and modifications of the present invention, the scope of which is delimited solely by the following claims.

I claim:

1. An end nesting stackable container, comprising:

(a) a frame, said frame having front, rear, left and right substantially vertical sides, said sides substantially defining a trapezoid in the horizontal plane, said front and rear sides being parallel, said front side being longer than said rear side, and said front side being substantially open;

(b) a top holddown mechanism having at least one holddown arm and at least one holddown support, said holddown arm being pivotally attached at or near one end to the holddown support at at least one holddown attachment point, said at least one holddown attachment point being located on at least one of said sides of said frame, said holddown arm being adapted to pivot to a loading position, thus allowing the container to nest with other like containers;

(c) a side stabilizing mechanism comprising at least one left side stabilizer on the left side of the load and at least one right side stabilizer on the right side of the load, said left side stabilizer being supported by at least one left side stabilizer support on the left side of the load, said left side stabilizer support being pivotally connected to a side attachment point on the left side of the frame, and said right side stabilizer being supported by at least one right side stabilizer support on the right side of the load, said right side stabilizer support being pivotally connected to a side attachment point on the right side of the frame, said at least one left and right side stabilizer supports being adapted to pivot said left and right side stabilizers to at least a loading position, a load-securing position, and a nesting position; and (d) side locking means for selectively holding the at least one left and right side stabilizers in the loading position or in the load-securing position, wherein the side locking means comprises at least one locking side support, at least one locking top support and at least one lock bar collar, the at least one locking side support is attached at or near one end to the container at a side attachment point and is attached at or near its other end to the at least one locking top support, and the lock bar collar is attached to the locking side support in a manner allowing the lock bar collar, after the container is loaded, to slide along the length of the locking side support to wedge into the angel formed between the side stabilizer support and the locking side support to hold the load firmly in place, wherein a first left clip is used to hold the at least one left side stabilizer in the nesting position, a first right clip is used to hold the at least one right side stabilizer in the nesting position, a second left clip is used to hold the at least one left side stabilizer in the loading position, and a second right clip is used to hold that at least one right side stabilizer in the loading position;

whereby, when said holddown arm and said at least one stabilizer are in said loading positions, the container can be stacked with another like container.

2. An end nesting stackable container as in claim 1, wherein the at least one holddown attachment point is adjustable along the length of the holddown support.

3. An end nesting stackable container as in claim 1, wherein the at least one holddown attachment point comprises a slot in the holddown support.

4. An end nesting stackable container as in claim 1, wherein the holddown arm is coated or covered on at least one side with a material suitable for protecting the load from damage.

5. An end nesting stackable container as in claim 1, wherein there are two holddown supports for each holddown arm.

6. An end nesting stackable container as in claim 1, wherein the holddown arm comprises a modified channel which includes a first channel section and a second channel section, the first channel section locating a removable cushion for protecting the load from damage, and the second channel section locating a top holddown strap.

7. An end nesting stackable container as in claim 6, further comprising a lock bar lever selectively and lockably located with respect to the locking side support, wherein the lock bar lever is pivotally connected to the side stabilizer support which supports the side stabilizer for engaging the load.

8. An end nesting stackable container as in claim 6, wherein the lock lever bar includes a toothed surface for engaging a surface of the locking side support.

9. An end nesting stackable container as in claim 6, wherein a lock lever bar and a locking side support are disposed at each of a front and rear of the container.

10. An end nesting stackable container as in claim 1, wherein the at least one left and right side stabilizers are coated or covered on at least one side with a material suitable for protecting the load from damage.

11. An end nesting stackable container as in claim 1, wherein there are two locking side supports attached to the locking top support.

12. An end nesting stackable container as in claim 11, which further comprises a lock bar attached at its first end to one lock bar collar and attached at its second end to the other lock bar collar.

13. An end nesting stackable container as in claim 12, which further comprises at least one locking clip attached to the lock bar.

14. An end nesting stackable container as in claim 1, wherein the side stabilizing mechanism and the side locking mechanism are adapted to be pivoted with respect to each other and with respect to the container.

15. A metal container pallet adapted for stacking and end-nesting with a second like container, comprising:

(a) four parallel vertical hollow tubular columnar posts respectively generally at the four corners of a trapezoid, with two posts at the rear of said container spaced closer than the two posts at the front of said container so that the rear posts may pass through between the front posts of a like container;

(b) four rigid bottom frame members rigidly connected to said corner posts in a horizontally extending planar relation, each of said frame members connecting two of said corner posts, said bottom frame members being spaced above the lower ends of said corner posts sufficiently to permit the forks of a lift truck to enter between said frame members and a floor upon which said corner posts rest;

(c) three rigid top frame members extending along the sides and the rear of said container at the top and rigidly connected to said posts and leaving the top open between said top frame members, the front of said container being open between said front corner posts, lower support members at the level of the bottom of the corner posts comprising inverted V-shape members linearly extending partially along each side of the container from each of the front and rear posts and rigidly connected to said corner posts and to said bottom frame members laterally inside of the inner edges of said front corner posts and closely adjacent thereto and laterally outside of the outer edges of said rear corner posts and closely adjacent thereto, the inverted V-shape members being joined along the front and sides of the container by flat members to form stirrups for accepting the forks of a lift truck;

(d) upper support members comprising two of said top frame members linearly extending uninterrupted along each side of the container from front to rear and each presenting its cross-section at the front end and rigidly connected to said corner posts and vertically directly above the corresponding lower support inverted V-shape members and complementary thereto, said upper support members being rigidly secured to said third top frame member laterally outside said rear corner posts and closely adjacent thereto and being rigidly secured laterally inside of said front corner posts and closely adjacent thereto, said upper support members being the uppermost parts of the sides of said container, whereby an upper second container may be stacked upon a first container by engaging the self-centering lower support members of the second container with the upper support members of the first container, and a second container may be nested in a first container by entering the second container into the open end and open top of a first container with the lower support inverted V-shape members of said second container engaging the bottom members of the first container;

(e) a side stabilizing mechanism comprising at least one left side stabilizer on the left side of the load, at least one right side stabilizer on the right side of the load, at least one left side stabilizer support on the left side of the load, and at least one right side stabilizer support on the right side of the load, wherein the at least one left and right side stabilizers are pivotally connected to their respective side stabilizer supports, and the side stabilizer supports are connected to the bottom frame of the container, such that said at least one left and right side stabilizers are adapted to pivot to a loading position, to a load-securing position, and to a nesting position, and wherein a first left clip is used to hold the at least one left side stabilizer in the nesting position, a first right clip is used to hold the at least one right side stabilizer in the nesting position, a second left clip is used to hold the at least one left side stabilizer in the loading position, and a second right clip is used to hold the at least one right side stabilizer in the loading position; and (f) side locking means for selectively holding the at least one left and right side stabilizers in the loading position or in the load-securing position, wherein the side locking means comprises at least one locking side support, at least one locking top support and at least one lock bar collar, the at least one locking side support is attached at or near one end to the container at a side attachment point and is attached at or near its other end to the at least one locking top support, and the lock bar collar is attached to the locking side support in a manner allowing the lock bar collar, after the container is loaded, to slide along the length of the locking side support to wedge into the angle formed between the side stabilizer support and the locking side support to hold the load firmly in place.

16. The metal container pallet of claim 15, wherein the upper support members are removably connected to the third top frame member by swivel locking mechanisms, each swivel locking mechanism comprising a truncated cylindrical pin secured to said third top frame member and at least one V-insert disposed in at least one notch in the upper support member, the V-insert engaging a slot in the truncated cylindrical pin by selective rotation of the upper support member, and the upper support members being removably connected to the front posts, each front post having a short metallic support extending inwardly therefrom to underlie the front of an upper support member, the short metallic support releasably engaging a notch in the upper support member.

17. The metal container pallet of a claim 15, wherein the two front posts are hingedly movable between lowered positions and upright positions.

18. A metal container pallet as in claim 15, wherein the at least one left and right side stabilizers are coated or covered on at least one side with a material suitable for protecting the load from damage.

19. A metal container pallet as in claim 15, wherein the at least one holddown attachment point is adjustable along the length of the holddown support.

20. A metal container pallet as in claim 15, further comprising a lock bar lever selectively and lockably located with respect to the locking side support, wherein the lock bar lever is pivotally connected to the side stabilizer support which supports the side stabilizer for engaging the load.

21. A metal container pallet as in claim 20, wherein the lock bar lever includes a toothed surface for engaging a surface of the locking side support.

22. A metal container pallet as in claim 15, wherein the holddown arm comprises a modified channel which includes a first channel section and a second channel section, the first channel section locating a removable cushion for protecting the load from damage, and the second channel section locating a top holddown strap.

* * * * *